US007147549B2

(12) United States Patent
Valentini

(10) Patent No.: US 7,147,549 B2
(45) Date of Patent: Dec. 12, 2006

(54) PLATE WITH DEFLECTOR FOR MACHINING SURFACES

(76) Inventor: Guido Valentini, Via Gioberti, 2, Milano (IT) I-20123

( * ) Notice: Subject to any disclaimer, the term of this patent is extended or adjusted under 35 U.S.C. 154(b) by 213 days.

(21) Appl. No.: 10/932,692

(22) Filed: Sep. 2, 2004

(65) Prior Publication Data

US 2005/0058518 A1 Mar. 17, 2005

(30) Foreign Application Priority Data

Sep. 11, 2003 (IT) ..... MI2003A1745

(51) Int. Cl.
*B24B 55/06* (2006.01)

(52) U.S. Cl. ..... 451/456; 451/344; 451/360; 451/549; 451/451

(58) Field of Classification Search ..... 451/344, 451/360, 359, 451, 456
See application file for complete search history.

(56) References Cited

U.S. PATENT DOCUMENTS 3,824,745 A * 7/1974 Hutchins ..... 451/359
4,616,449 A 10/1986 Marton
5,545,080 A * 8/1996 Clowers et al. ..... 451/359
5,791,979 A * 8/1998 Duncan et al. ..... 451/456
7,048,620 B1 * 5/2006 Riley et al. ..... 451/359
2003/0148719 A1 8/2003 Reich et al.

FOREIGN PATENT DOCUMENTS

DE 42 26 741 A 1 2/1994
WO WO 02/072313 A1 9/2002

* cited by examiner

*Primary Examiner*—Joseph J. Hail, III
*Assistant Examiner*—Shantese L. McDonald
(74) *Attorney, Agent, or Firm*—Arnold B. Silverman; Robert A. Diaz; Eckert Seamans Cherin & Mellott, LLC

(57) ABSTRACT

The present invention describes a plate comprising a mono-block body through which a plurality of holes pass, and a deflector that covers at least the external part of the upper surface of said mono-block body. The mono-block body is made up of a rigid support sunk into a flexible body and provided with a holed peripheral part. Said deflector partially or completely covers said peripheral part of the rigid support and presents in the second case a plurality of slits for the passage of the dust sucked through said holes.

10 Claims, 8 Drawing Sheets

PLATE WITH DEFLECTOR FOR MACHINING SURFACES

DESCRIPTION

The present invention refers to a plate with deflector for machining surfaces.

The currently known plates consist of a circular or differently shaped body, that is equipped with a central tang for connecting to a portable tool and has axial holes passing through it for the machining dust, that is suitably sucked up by suction systems associated to the tool.

The suction system connected to the portable tool causes the dust to pass through the holes of the plate towards the upper part of the same plate, on which a cap is positioned that conveys the withdrawn material towards a suction tube.

Said upper part of the plate consists of a rigid support, provided with a plurality of holes, that is made integral with a lower part of flexible material by means of a screw connection or by gluing.

The known plates have a limited number of holes in virtue of the fact that it is necessary to make sure that the most external holes remain inside the area covered by the cap, that necessarily will be less than the lower surface of the plate from where the dust is sucked.

A limited number of holes means a lower suction capacity.

The object of the present invention is to produce a plate capable of effectively conveying the dust inside the cap and ensure a better and more efficient positioning of the cap itself on the upper surface of the plate.

In accordance with the invention this object is achieved with a plate characterised in that it comprises a mono-block body through which a plurality of holes pass and a deflector covering at least the external part of the upper surface of said mono-block body.

These and other characteristics of the present invention will be made more evident from the following detailed description of three embodiments thereof illustrated as non-limiting examples in the attached drawings in which.

Figure 1:
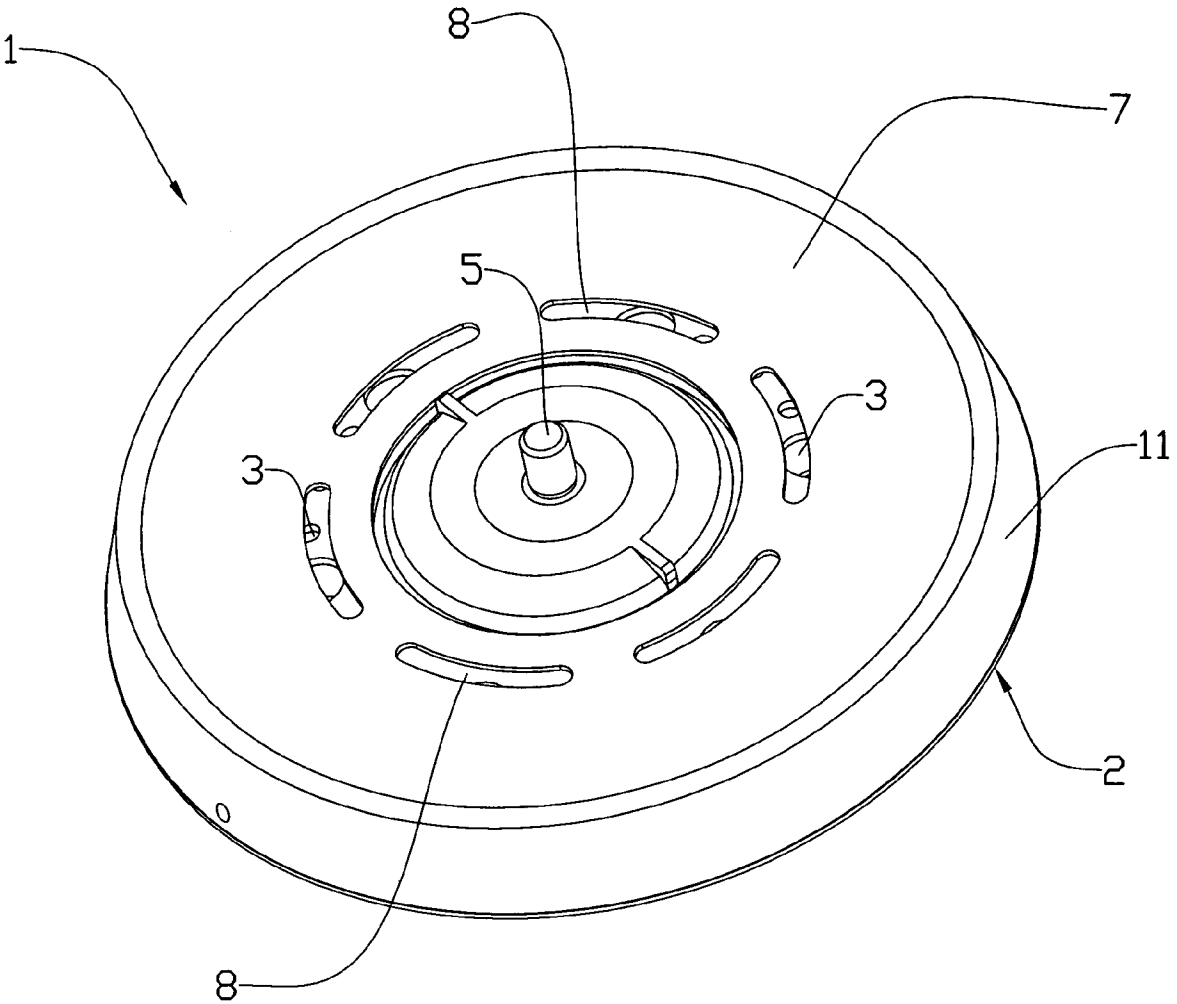
FIG. 1 shows an axonometry of a first embodiment of the plate with deflector according to the present invention.

A plate 1 with circular shape comprises a mono-block body 2 made up of a rigid support 10 in thermoplastic material, preferably in nylon, and a flexible holed body 11, preferably in polyurethane foam, in which said rigid support 10 is sunk. Said plate 1 is also provided with holes 3 and cavities 4, and is placed in rotative or roto-orbital motion, in relation to the frame of the portable tool that supports it, by a mechanism (not shown in the figures) that is part of a portable tool and is connected to a central threaded pin 5 suitably shaped, fastened to the support 10.

A thin layer 6 of holed Velcro covers the lower surface of the plate 1, enabling a sheet of abrasive material to adhere for interacting with the surface to be machined.

The external edge of the body 2 of the plate 1 is shaped so that, above said plate 1, a deflector 7 can be fitted in, on which a cap 9 is placed, which the portable tool is equipped with to contain and convey towards a suction tube the dust drawn inside it through the holes 3 and the cavities 4.

In a first embodiment (FIGS. 1–3) said deflector 7 completely covers the holed peripheral part of the support 10 of the plate 1 until it encloses the central portion of said support 10, and is fitted with slits 8 for the outlet of the dust.

Figure 4:
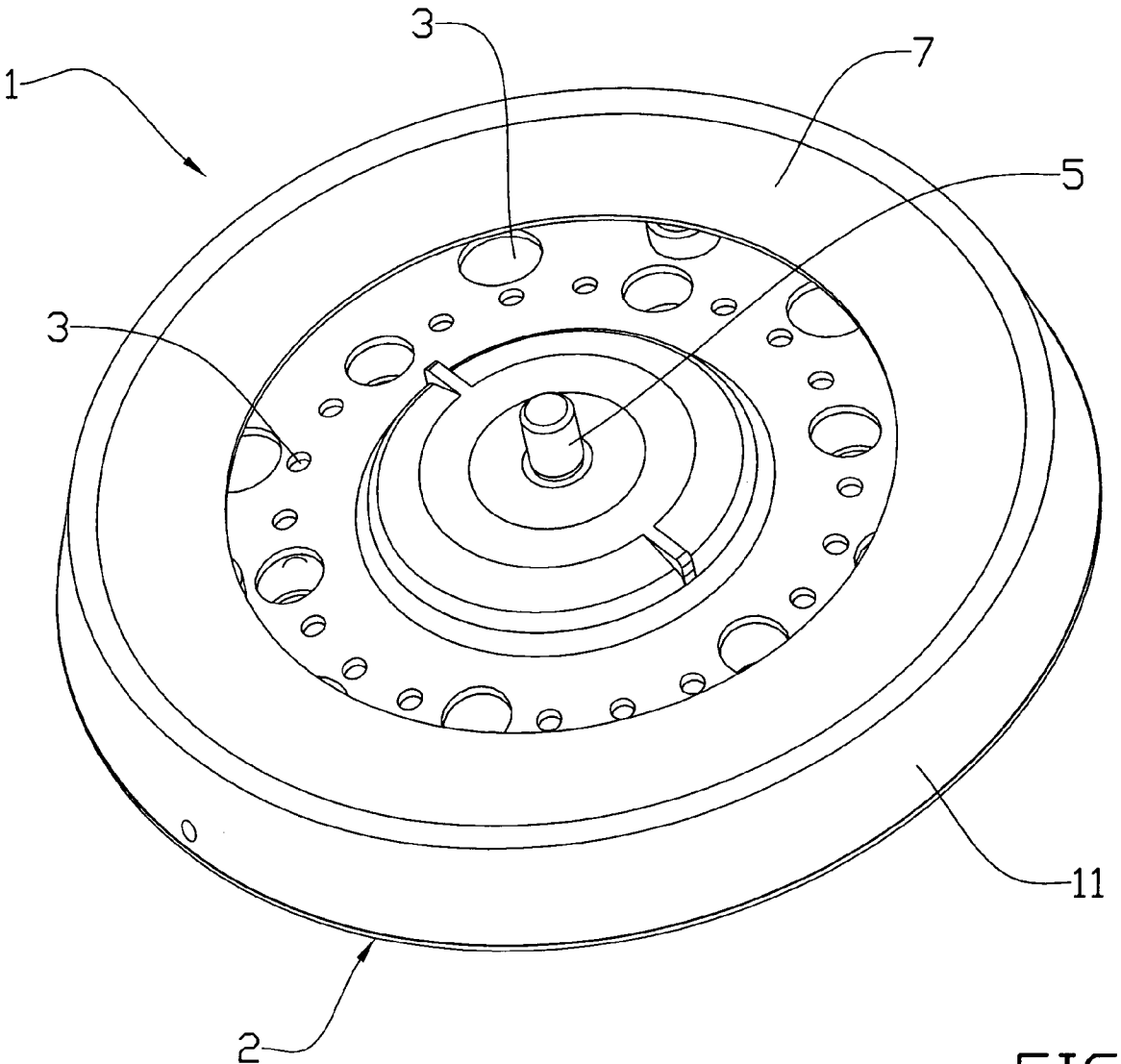
FIG. 4 shows an axonometry of a second embodiment of the plate with deflector according to the present invention.
Figure 5:
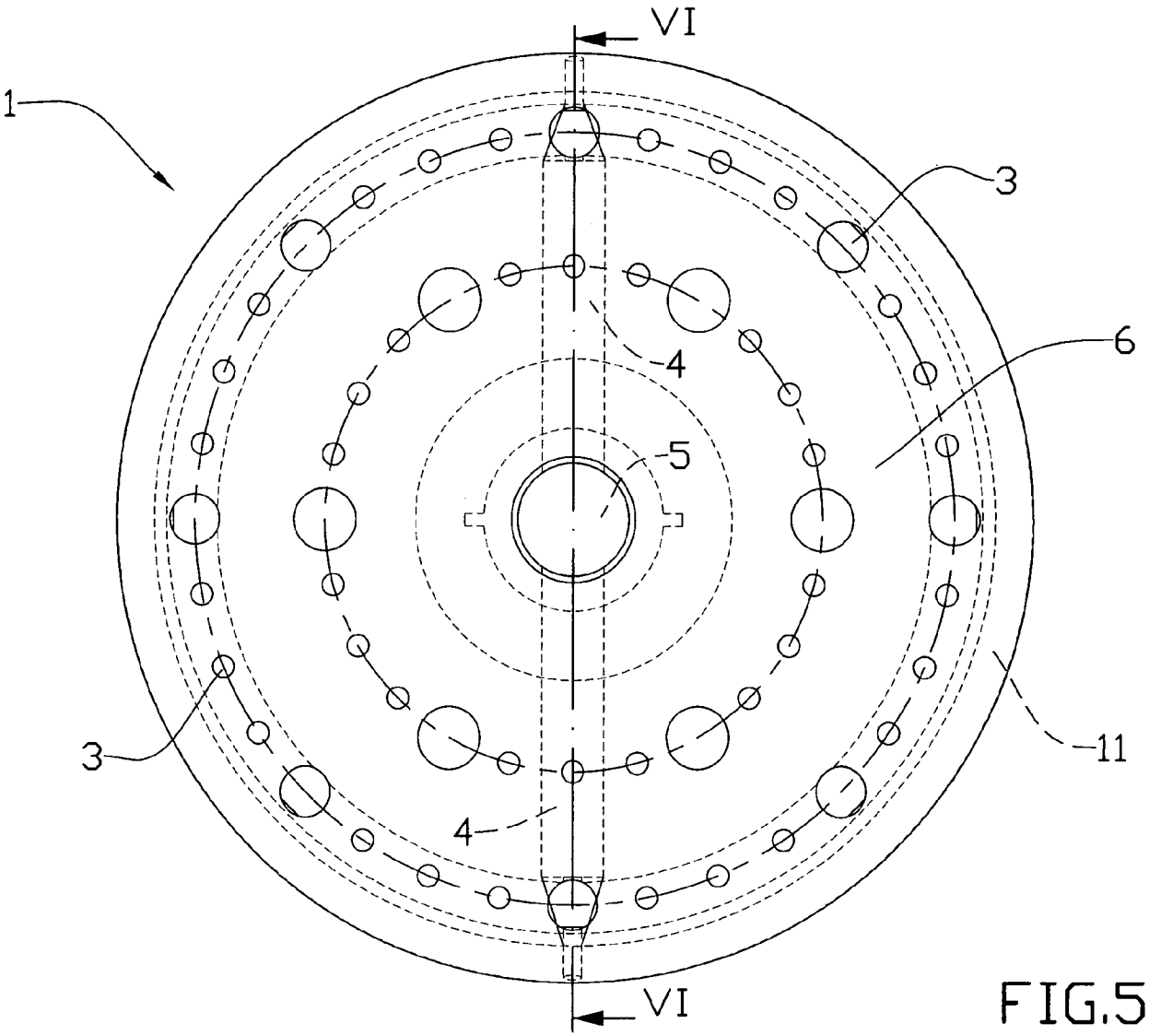
FIG. 5 shows a plan view from below of the plate in FIG. 4.
Figure 6:
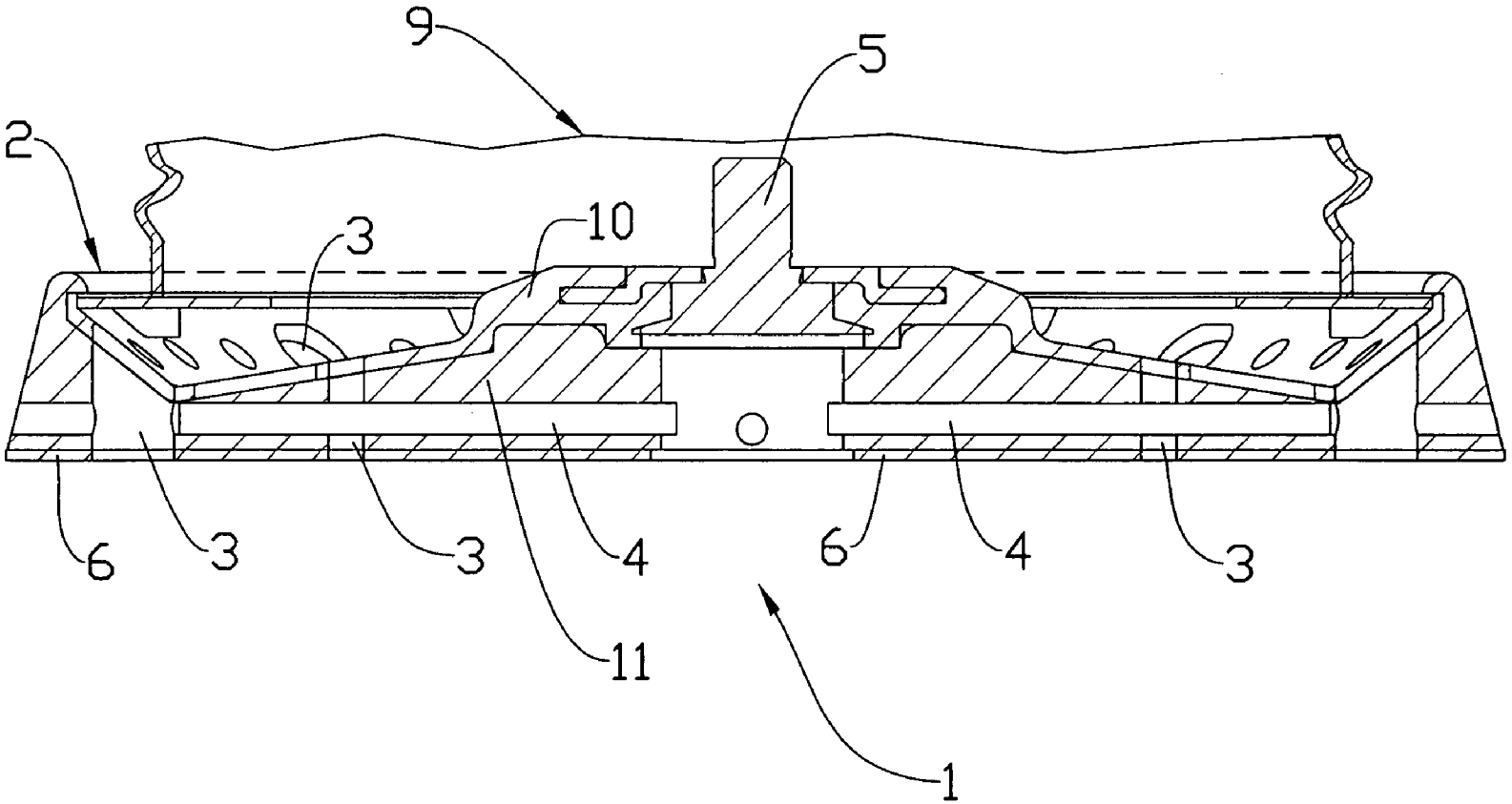
FIG. 6 shows a section according to the line VI—VI in FIG. 5.

In the embodiment shown in the FIGS. 4–6, the deflector 7, without slits 8, only covers an external part of the support 10, leaving the central area for the passage of the dust towards the cap 9 and thus towards the suction tube.

Figure 2:
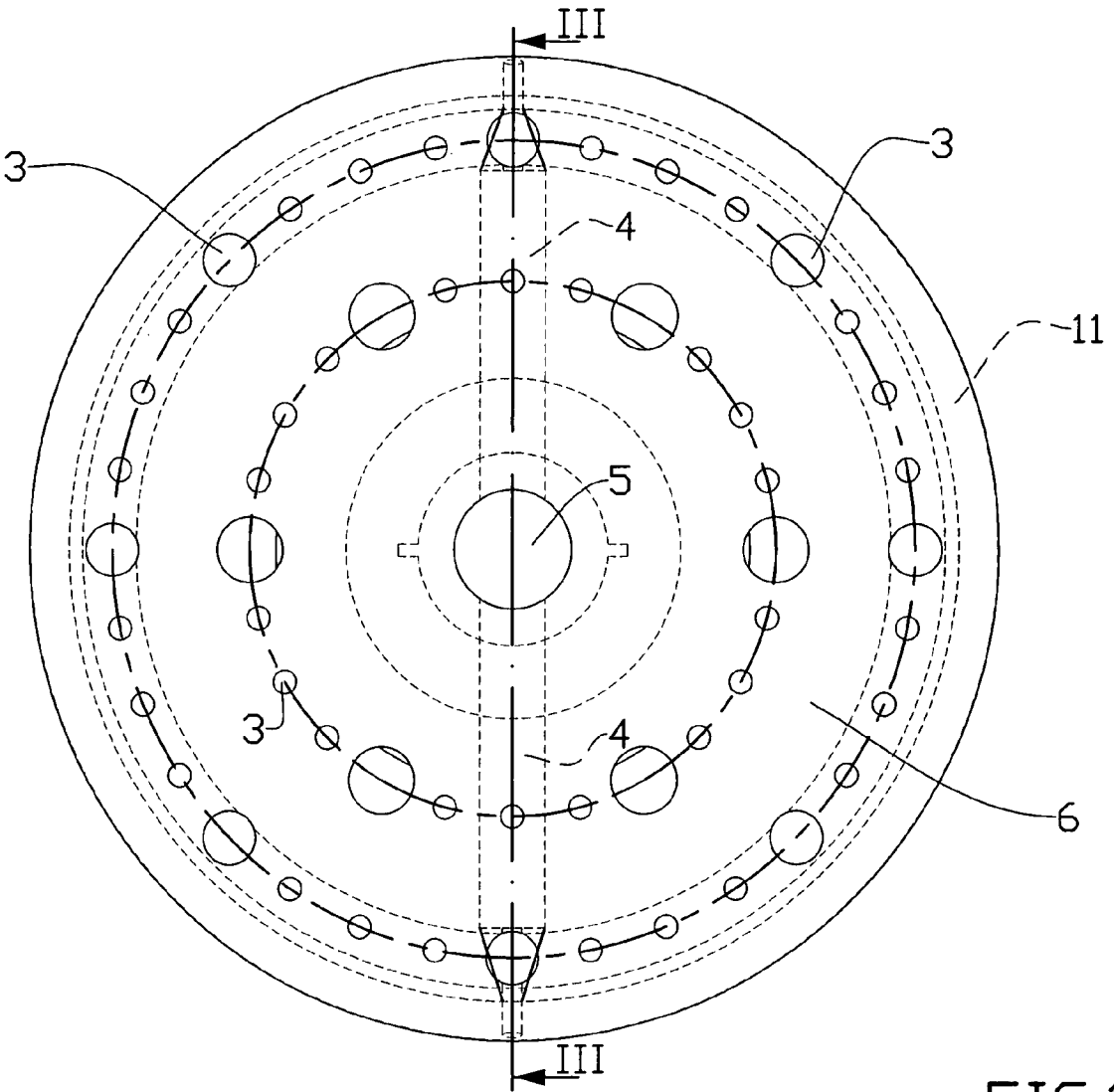
FIG. 2 shows a plan view from below of the plate in FIG. 1.
Figure 3:
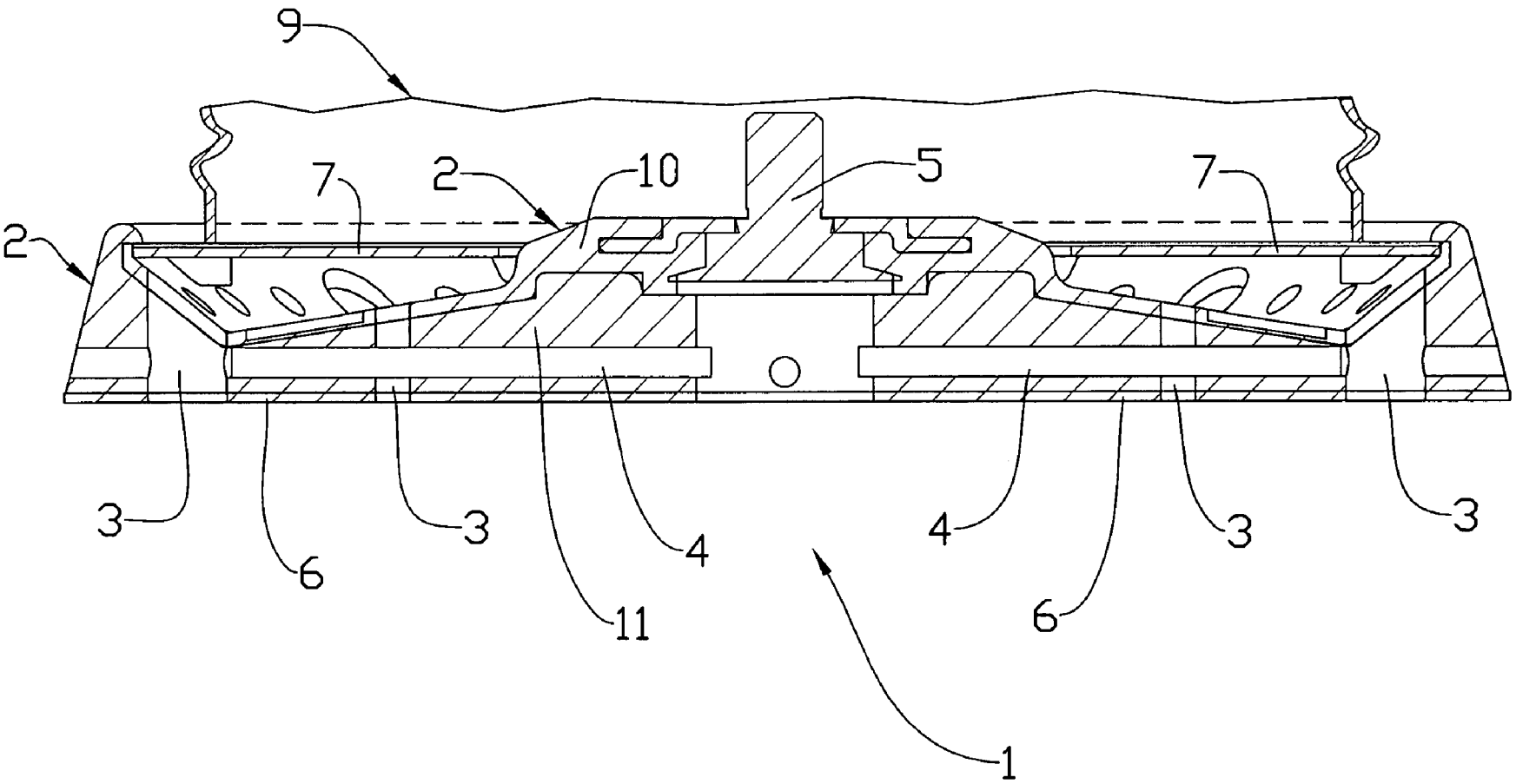
FIG. 3 shows a section according to the line III—III in FIG. 2.

Except for the deflector 7, said second embodiment (FIGS. 4–6) is completely the same as the previous one illustrated in the FIGS. 1–3.

Figure 8:
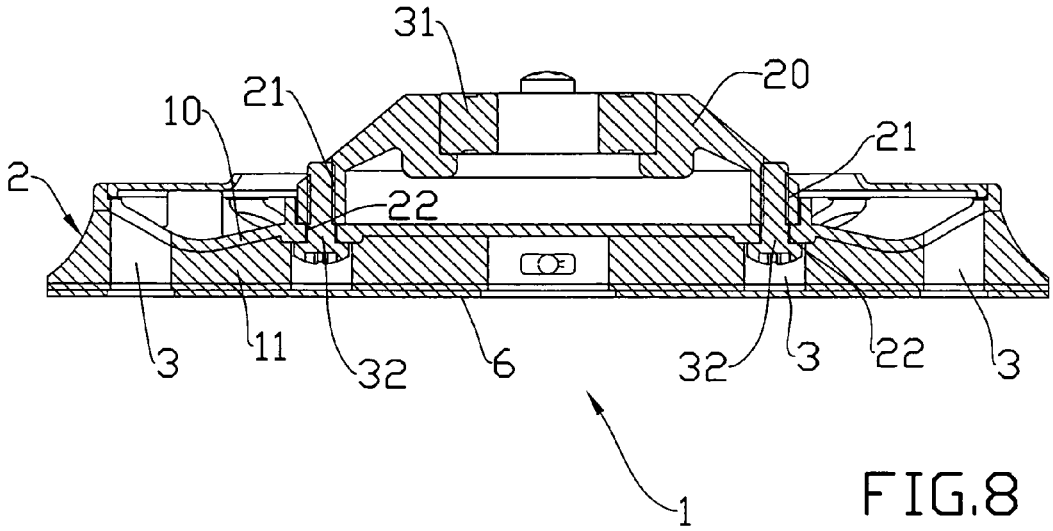
FIG. 8 shows a section according to the line VIII—VIII in FIG. 7.
Figure 9:
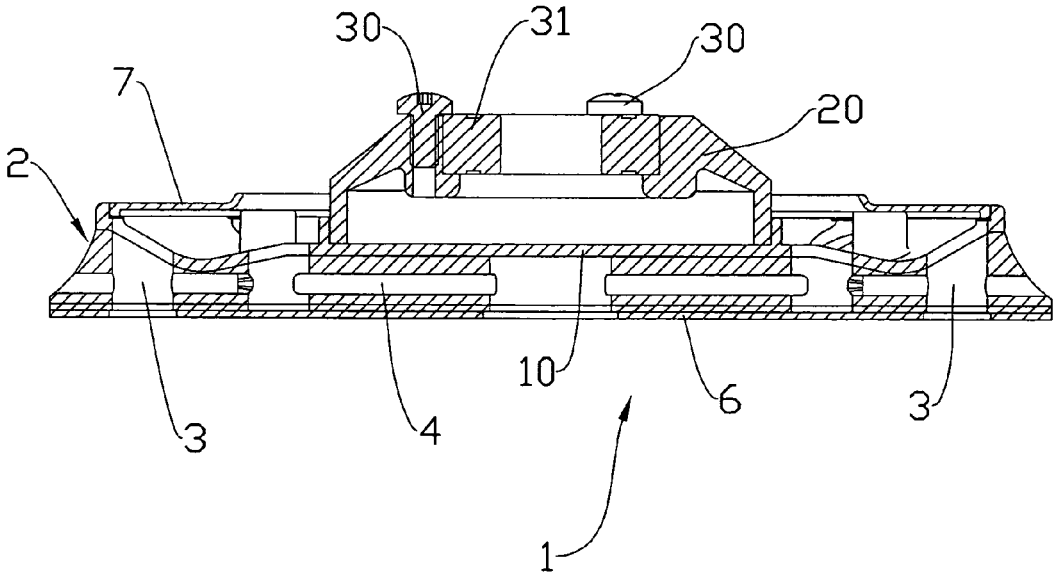
FIG. 9 shows a section according to the line IX—IX in FIG. 7.

In a third embodiment of the plate (FIGS. 7–9) the function of the pin 5 is carried out by a plate 20 provided with threaded holes 21, that is fastened to the tool and can be connected to the mono-block 2 of the plate 1.

In addition, the support 10 presents holes 22 whose diameter is slightly longer than that of the holes 21, and overlay several holes 3 of the body 11 of the mono-block 2. The holes 21 after assembly will overlay said holes 22 and thus above-mentioned holes 3 of the body 11. Threaded screws 32 enable the plate 20 to be connected with the support 10.

A bearing holder 31 that receives the rotating shaft of the tool by means of a bearing (not shown) is fastened by means of threaded screws 30 to the plate 20.

Figure 7:
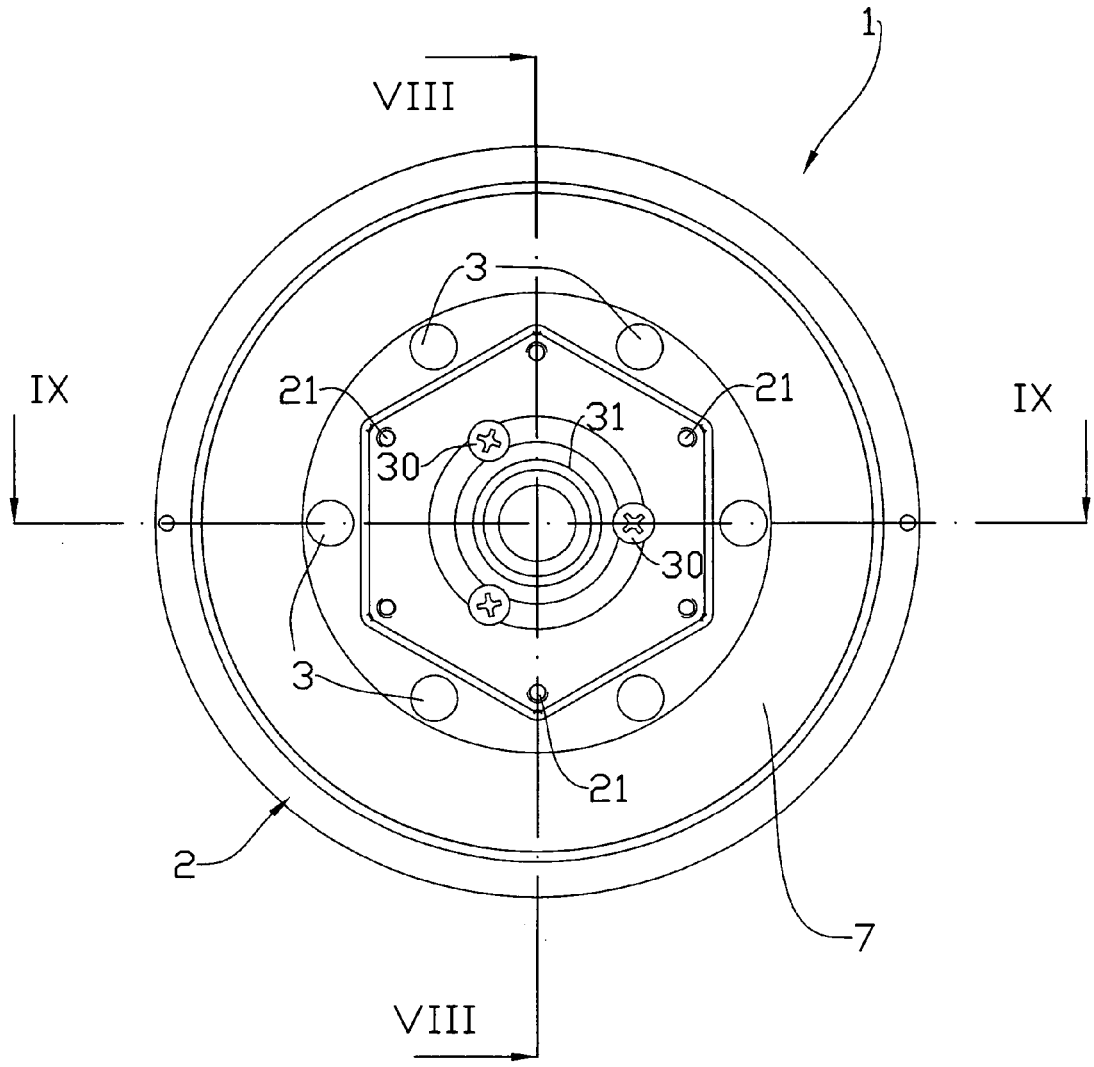
FIG. 7 shows a view from above of a third embodiment of the plate with deflector according to the present invention.

In FIG. 7 it can be seen that the deflector 7 is the same type as that in the second embodiment, that is, without slits 8.

During the machining phase the plate moves with rotative or roto-orbital motion in relation to the frame of the tool which it is linked to (through the pin 5 or the plate 20), and the dust produced by the interaction of the abrasive sheet with the surface to be machined is removed by means of a suction system, not shown in the figures.

The dust particles pass through the holes 3 and the cavities 4 and reach the upper part of the plate 1 going partially to hit against the deflector 7. The suction flow forces the dust to go towards the centre of the plate 1 where it can ascend, through the slits 8 in the case of the first embodiment, towards the suction tube, possible side leakages being stopped by the presence of the junction cap 9. The deflector 7 thus permits a suction chamber to be created for the machining dust.

The presence of deflector 7 permits the mono-block body of the plate 1 to be holed as required, as the limit of the area covered by the cap 9 is no longer a critical factor. The diameter of the cap 9 is now variable enough; it is sufficient that it is placed on the deflector 7.

It is to be noted that the more external holes 3 present upper sloping openings towards the centre of the plate for the outlet of the dust.

The deflector 7 permits the loss of dust into the surrounding atmosphere to be limited and the flow of air sucked in to be increased.

The dust is "guided" towards the suction tube without excessively stressing the junction cap that could present a precarious seal. In addition the cap has a greater and smoother support surface that improves the hold and lessens wear.

The first embodiment permits less dispersion but also entails lower suction capacity.

Vice versa the second and the third embodiment enable a greater quantity of dust to be sucked in the unit of time but guarantee less seal which however remains greater than that of the known plates.

According to the uses the most suitable deflector 7 will be selected, keeping however the same body 2 of the plate 1 and the same portable tool. The body 2 in turn will be able to use a threaded pin 5 or a plate 20 for connection to the tool.

It is to be highlighted that, while the pin 5 is fastened by clipping into the body 2, the plate 20 is integral with the tool and can be joined to said body 2 by means of bolts (not shown).

Once the plate 20 (with the tool) has been placed on the support 10 of the plate 1 so as to make holes 21 correspond to holes 22 of said support 10, said screws are inserted into said 21–22 thus ensuring the fastening.

It is to be highlighted that the technique with which the support 10 is connected irreversibly to the body 11 below, that is by "sinking", permits a more compact plate to be obtained. The presence of the deflector 7, very easy to mount, enables on the other hand, many holes to be made in the mono-block body and, suitably choosing the material of the deflector, causes lower wear of the cap 9.

The invention claimed is:

1. Plate characterised in that it comprises a mono-block body through which a plurality of holes pass, and a deflector covering at least the external part of the upper surface of said mono-block body, said mono-block body is made up of a rigid support sunk into a flexible body and provided with a holed peripheral part and said deflector completely covers said peripheral part of the rigid support and presents a plurality of slits for the passage of the dust sucked through said holes.

2. Plate according to claim 1, characterised in that said support is in thermoplastic material.

3. Plate according to claim 1, characterised in that said flexible body is in foam material.

4. Plate according to claim 1, characterised in that a central threaded pin is connected to said support.

5. Plate according to claim 1, characterised in that said support can be connected by means of a first screws to a plate fastened to the tool and the plate is provided with holes that overlay holes of the support.

6. A plate comprising a mono-block body provided with passing-through holes and a deflector covering partially the upper surface of said mono-block body, said mono-block body being made up of a rigid support sunk into a flexible body and having a holed peripheral part, and said deflector covers only an external portion of said hold peripheral part.

7. The plate according to claim 6, characterised in that said support is in thermoplastic material.

8. The plate according to claim 6, characterised in that said flexible body is in foam material.

9. The plate according to claim 6, characterised in that a central threaded pin is connected to said support.

10. The plate according to claim 6, characterised in that said support can be connected by means of a first screws to a plate fastened to the tool and the plate is provided with holes that overlay holes of the support.

* * * * *